US009257250B2

(12) United States Patent
Pagani

(10) Patent No.: US 9,257,250 B2
(45) Date of Patent: Feb. 9, 2016

(54) MAGNETIC RELAY DEVICE MADE USING MEMS OR NEMS TECHNOLOGY

(71) Applicant: STMicroelectronics S.r.l., Agrate Brianza (IT)

(72) Inventor: Alberto Pagani, Nova Milanese (IT)

(73) Assignee: STMicroelectronics, S.r.l., Agrate Brianza (IT)

( * ) Notice: Subject to any disclaimer, the term of this patent is extended or adjusted under 35 U.S.C. 154(b) by 0 days.

(21) Appl. No.: 14/062,698

(22) Filed: Oct. 24, 2013

(65) Prior Publication Data

US 2014/0145804 A1 May 29, 2014

(30) Foreign Application Priority Data

Nov. 28, 2012 (IT) ..... TO12A1027

(51) Int. Cl.

| | |
|---|---|
| ***H01H 50/16*** | (2006.01) |
| ***H01H 1/00*** | (2006.01) |
| *H01H 50/00* | (2006.01) |
| *H01H 51/26* | (2006.01) |

(52) U.S. Cl.

CPC ..... *H01H 50/16* (2013.01); *H01H 1/0036* (2013.01); *H01H 50/005* (2013.01); *H01H 51/26* (2013.01); *H01H 2001/0078* (2013.01); *H01H 2001/0084* (2013.01); *H01H 2050/007* (2013.01)

(58) Field of Classification Search

CPC ..... H01H 50/005; H01H 2050/007

See application file for complete search history.

(56) References Cited

U.S. PATENT DOCUMENTS

| | | | | |
|---|---|---|---|---|
| 5,638,946 | A | 6/1997 | Zavracky | |
| 5,889,452 | A * | 3/1999 | Vuilleumier | H01H 50/005 257/421 |
| 6,320,145 | B1 | 11/2001 | Tai et al. | |
| 7,262,680 | B2 | 8/2007 | Wang | |
| 8,436,701 | B2 | 5/2013 | Baks et al. | |
| 8,604,570 | B2 | 12/2013 | Pagani et al. | |

(Continued)

FOREIGN PATENT DOCUMENTS

| | | | |
|---|---|---|---|
| WO | 99/50863 | A2 | 10/1999 |
| WO | 2010/076187 | A2 | 7/2010 |

OTHER PUBLICATIONS

Gardner et al., "High Frequency (GHz) and Low Resistance Integrated Inducers Using Magnetic Materials," IEEE International Interconnect Technology Conference, pp. 101-103, Jun. 6, 2001.

*La tecnica moderna dei relé:*, "Costruzione e funzioni particolari dei reléelettromagnetici," Verlag, pp. 22-25, 1988, 5 pages. (with Partial Machine Translation).

(Continued)

*Primary Examiner* — Ramon M Barrera

(74) *Attorney, Agent, or Firm* — Seed IP Law Group PLLC

(57) ABSTRACT

A magnetic relay device having a substrate of semiconductor material houses two through magnetic vias of electrically conductive ferromagnetic material. At least one coil is arranged underneath a first surface of the substrate in proximity of at least one between the first and second magnetic vias, and a contact structure, of ferromagnetic material, is arranged over a second surface of the substrate and is controlled by the magnetic field generated by the coil so as to switch between an open position, wherein the contact structure electrically disconnects the first and second magnetic vias, and a close position, wherein the contact structure electrically connects the first and second magnetic vias.

23 Claims, 6 Drawing Sheets

(56) References Cited

U.S. PATENT DOCUMENTS

2003/0151480 A1* 8/2003 Orr ..... 335/78
2012/0200377 A1 8/2012 Lee et al.

OTHER PUBLICATIONS

Lotti et al., "Tecnologia Delle Construzioni Elettroniche," vol. I., Cap. CV *Relé*, La Sovrana Editrice, pp. 524-526, 1990, 5 pages. (with Partial Machine Translation).

* cited by examiner

MAGNETIC RELAY DEVICE MADE USING MEMS OR NEMS TECHNOLOGY

BACKGROUND

1. Technical Field

The present disclosure relates to a magnetic relay device made using MEMS (microelectromechanical systems) or NEMS (nanoelectricalmechanical systems) technology.

2. Detailed Description

As is known, relays are traditionally used as switches in power circuits, for example for controlling actuators and DC electric motors, due to their capacity for carrying and interrupting high electric currents.

For example, relays are used in applications requiring a very high resistance in an open condition (e.g., a resistance of the order of megaohms) and a very low resistance in the closed condition (e.g., a resistance of tens of microohms).

Traditional relays, such as reed relays and the like, are, however, very cumbersome, to the point of being at times much bulkier than the devices to be controlled.

This dimension relationship is becoming increasingly more evident, given the trend towards miniaturization of control and driving devices and, at times, of the utilizers.

In the last few years, integrated relays have thus been proposed that have dimensions comparable to those of integrated circuits and may be directly connected to logic devices. For example, U.S. Pat. No. 6,320,145 discloses a magnetostatic relay or switch obtained using the MEMS manufacturing technique and having a beam extending as a cantilever above a substrate. The beam, of conductive material and provided with a magnetic material layer, such as permalloy, or made directly of magnetic material, is mobile under the influence of a magnetic field generated on an opposite side of the substrate so as to touch, or move away from, a contact formed on the substrate, thus closing and opening a circuit.

Even though this solution enables a reduction in dimensions, it may be improved. In fact, the distance between the magnetic-field generator and the contact structure does not ensure proper operation of the relay, unless strong magnetic fields are used, which may prove disadvantageous or impossible in certain applications. In addition, upon opening of the contact, sparks are created that deteriorate the material, reducing the service life of the relay. In addition, with use, the beam tends to undergo deformation, also on account of the existing electrostatic forces, rendering more difficult proper contact and/or separation during switching.

BRIEF SUMMARY

One or more embodiments are direct to relays or switch devices, including a magnetic relay device and a method for controlling a relay device In one embodiment, the magnetic relay comprises two through vias of conductive magnetic material formed in a substrate of semiconductor material, a connection structure, including at least one cantilever beam, which is also of conductive magnetic material, and at least one coil, arranged near one of the magnetic vias and generating a concentrated magnetic field in the magnetic vias. The beam is arranged above the substrate, extends between the two magnetic vias, and is mobile as a result of the generated attraction and/or repulsion forces between a close position, in which it electrically connects the magnetic vias and the relay is thus in a closed state, and an open position, in which the beam extends at a distance from at least one of the two magnetic vias, and the relay is thus in an open state.

In particular, the beam has at least one flexible cantilever portion, which opens and closes the contact with a magnetic via and may be fixed to the other magnetic via, or may have a second cantilever portion, also mobile between a contact and an open position.

Instead of a single beam, two beams may be provided that attract and repel transversely or parallel to the top surface of the substrate.

The magnetic relay may comprise two magnetic coils, each of which is arranged in proximity of a respective magnetic via; in this case, repulsion forces may be generated between the beam and the magnetic via closing the contact, to enable a safe opening of the relay without any sparking.

BRIEF DESCRIPTION OF THE SEVERAL VIEWS OF THE DRAWINGS

For a better understanding of the present disclosure, preferred embodiments thereof are now described, purely by way of non-limiting example, with reference to the attached drawings, wherein.

DETAILED DESCRIPTION

Figure 1:
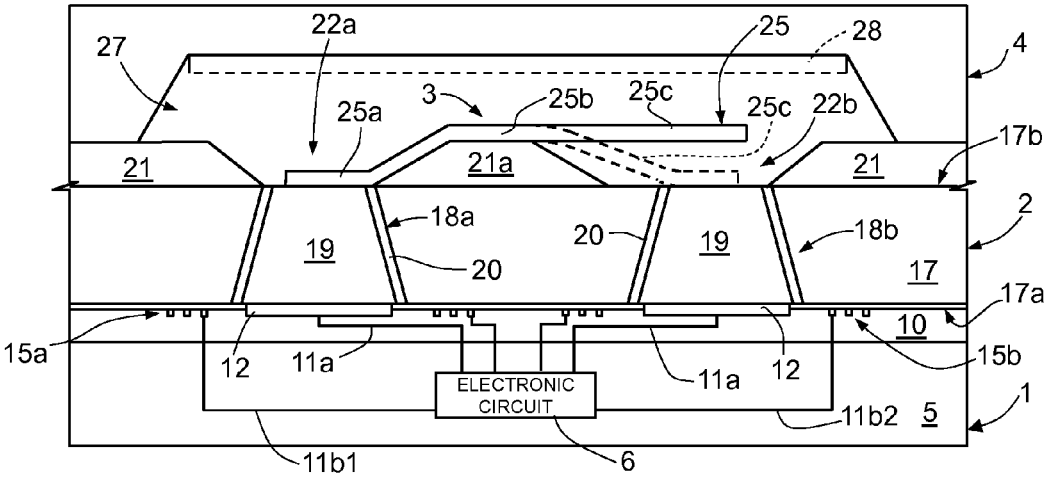
FIG. 1 is a cross-section through an embodiment of a MEMS device integrating the present magnetic relay.

FIG. 1 shows a magnetic-relay integrated device comprising a first body 1, a second body 2 forming a magnetic relay 3, and a cap 4, which are arranged on top of one another and are fixed together.

In the shown embodiment, the first body 1 forms, for example, an ASIC (application-specific integrated circuit) or a SoC (system-on-chip) and comprises a first substrate 5 and a first insulating layer 10.

The first substrate 5 is of semiconductor material (for example, silicon) and embeds an electronic circuit 6 connected to the magnetic relay 3.

The electronic circuit 6 is of any type, and in general comprises a power part and is for example formed by a control part and a driving part for a further system, for example an electric motor.

The first insulating layer 10 coats the first substrate 5 and may be formed by more insulating and/or passivation layers in a per se known manner in integrated circuit technology. The first insulating layer 10 embeds structures for electrically connecting the components of the electronic circuit 6 to each other and structures for connecting the electronic circuit 6 and the magnetic relay 3. For example, the connection structures may comprise metallizations, conductive vias, plugs, and other types of known connection elements.

In the example shown, the first insulating layer 10 embeds first electrical-connection lines 11*a*, which extend between the electronic circuit 6 and contact pads 12 that face the surface of the first body 1 intended to come into contact with the second body 2.

In addition, the first insulating layer 10 houses two coils 15*a*, 15*b* connected to the electronic circuit 6 via second electrical-connection lines 11*b* extending between the electronic circuit 6 and the coils 15*a*, 15*b*. The coils 15*a*, 15*b* may be embedded inside the first insulating layer 10 or, if they are formed near its surface facing the second body 2, be coated by a thin insulating layer, for electrical insulation vs. the second body 2. Typically, the coils 15*a*, 15*b* are planar, i.e., their turns are formed in a same metal layer. However, embodiments are possible where the coils 15*a*, 15*b* are formed by turns in different metal layers.

The second body 2 is formed by a second substrate 17 for example of semiconductor material (such as silicon). The second body 2 preferably has a high resistivity (e.g., higher than 10 Ω·cm) and integrates a first magnetic via 18*a* and a second magnetic via 18*b*, arranged on top of, and in electrical contact with, respective contact pads 12. The magnetic vias 18*a*, 18*b* are through vias (for example through-silicon vias), and thus extend between a first and a second surfaces 17*a*, 17*b* of the second substrate 17, and may be manufactured as described in WO 2010/076187. In the example, the magnetic vias 18*a*, 18*b* have the shape of a truncated pyramid or a truncated cone arranged upside down, and comprise a core 19 of magnetic material and a coating 20 of insulating material, for example silicon oxide. In particular, the core 19 may be made of soft magnetic material, such as permalloy, CoZrTa, CoZrO, FeHfN(O), and the like.

The magnetic vias 18*a*, 18*b* are arranged in such a way that, in top plan view (as shown, for example, in FIG. 3), they are surrounded by the coils 15*a*, 15*b*.

A second insulating layer 21, for example of silicon oxide, extends on the second surface 17*b* of the second substrate 17 and has two openings 22*a*, 22*b* facing the magnetic vias 18*a*, 18*b*. The openings 22*a*, 22*b* may have any shape, for example, in top plan view, circular, square, or polygonal, or even form part of a single opening of an annular shape, the cross-section of which may be seen in FIG. 1. In all cases, between the openings 22*a*, 22*b* or inside the single circular opening, the second insulating layer 21 forms an insulating portion 21*a*.

A beam 25 extends over the second substrate 17, for selective connection of the magnetic vias 18*a*, 18*b*, and is made of magnetic material having a good electric conductivity, such as, for example, NiFe, CoZrTa, CoZrO, NiMn, CoFe.

The beam 25 forms a contact structure and is an expansion of one of the two magnetic vias 18*a*, 18*b*, here the first magnetic via 18*a*. In detail, the beam 25 comprises a first end portion, forming an anchorage portion 25*a*, fixed to and in direct electrical contact here with the first magnetic via 18*a*; an intermediate portion 25*b*, connected to the anchorage portion 25*a* and extending over the insulating portion 21*a*; and a second end portion, forming a contact portion 25*c* as a prolongation of the intermediate portion 25*b* and vertically flexible. Given its configuration and the elasticity of the magnetic material of the beam 25, the contact portion 25*c* may move between a rest position, represented with a solid line, in which it extends at a distance from the second magnetic via 18*b*, and a close position, here represented by a dashed line, in which the contact portion 25*c* is in direct electrical contact with the second magnetic via 18*b* so as to electrically connect the magnetic vias 18*a*, 18*b*, as explained in greater detail hereinafter.

The cap 4, for example of semiconductor material, is fixed to the second insulating layer 21 and has, on the inside, a cavity 27 accommodating the beam 25. In this way, the cap 4 and the second substrate 17 form a package that protects the beam 25 from damage and prevents foreign particles from setting themselves between the contact portion 25*c* and the second magnetic via 18*b*, preventing contact.

A getter layer 28 may extend inside the cavity 27, for example on the beam 25. The getter layer 28 is useful for eliminating any oxygen or creating vacuum inside the cavity 27, reducing and in some cases eliminating oxidation of the electrical contacts and viscous friction of the beam 25 with the gases in the cavity 27. The getter layer may be, for example, of ferrite or alumina, providing also magnetic shielding. In this way, any possible external magnetic fields cannot alter operation of the magnetic relay 3.

The device of FIG. 1 may be obtained by separately machining the first body 1, the second body 2, and the cap 4, and bonding them together at the end. In particular, the magnetic vias 18*a*, 18*b* may be formed as described in WO 2010/076187. Then, the second insulating layer 21 is formed and shaped, the opening 22*b* is filled by a sacrificial region (of a material that may be selectively removed with respect to the material of the second insulating layer 21, for example silicon nitride) and a magnetic layer is deposited and shaped to form the beam 25. Finally, the sacrificial layer is removed.

Figure 2:
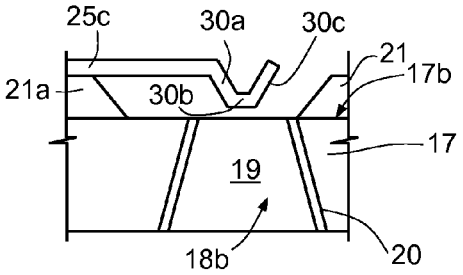
FIG. 2 shows a variant of a detail of FIG. 1.

FIG. 2 shows a variant of the contact portion 25*c* that helps contact with the second magnetic via 18*b*. Here, the end of the contact portion 25*c* forms a sort of U or V, including a first inclined portion 30*a*, which extends from the beam towards the second magnetic via 18*b*; a base, which extends in proximity of the second magnetic via 18*b* substantially parallel to the second surface 17*b* of the second body 17 (or with an angle such as to be parallel to the second surface 17*b* following upon bending of the beam 25); and a second inclined portion 30*c* that moves away from the second surface 17*b*.

Figure 3:
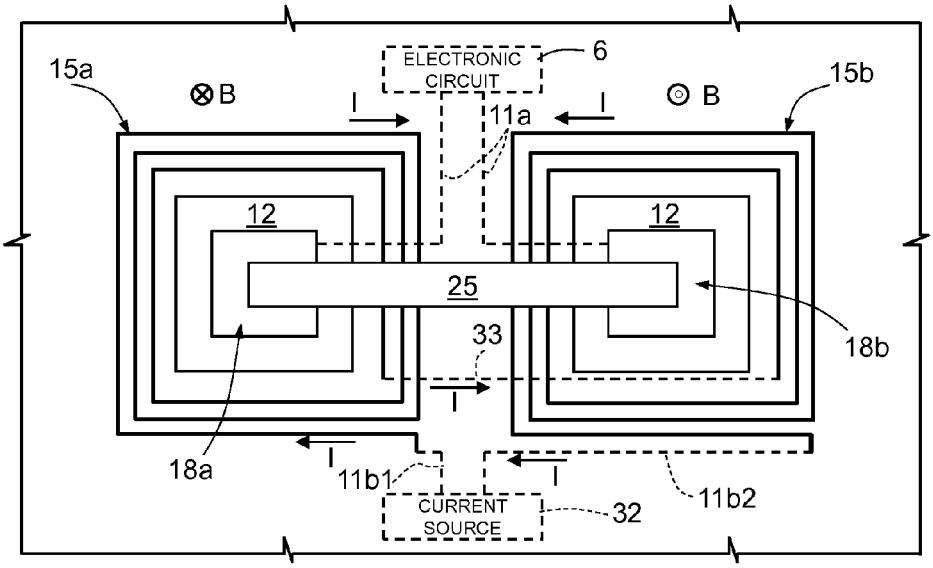
FIG. 3 is a top plan view of the electrical connection of parts of the device of FIG. 1.

FIG. 3 shows a possible connection of the coils 15*a*, 15*b* to a supply circuit, here exemplified by a current source 32. The current source 32 is here shown separate from the electronic circuit 6, integrated in the first substrate 5 or in the second substrate 17, but it could be comprised inside the electronic circuit 6 of FIG. 1. In the embodiment of FIG. 3, the coils 15*a*, 15*b* are connected in series so as to be passed by currents of the same value but having opposite directions (in top plan view). In the example shown, the current source 32 generates a current I supplied, through a first electrical-connection line 11*b*1, to the first coil 15*a* at its outer end. The current I thus flows in the first coil 15*a* in a clockwise direction; then, through a line 33 (formed, for example, in the first insulating layer 10) it is supplied to the inner end of the second coil 15*b*, where it flows in a counterclockwise direction and returns to the current source 21 through a second electrical-connection line 11*b*2.

Thereby, in the cores 19 of the first and second magnetic vias 18*a*, 18*b* magnetic fields B of opposite direction are generated; the facing portions of the contact portion 25*c* and of the second magnetic via 18*b* form poles of opposite sign that attract and deflect the contact portion 25*c* in the direction of, and in direct contact with, the core 19 of the magnetic via 18*b*, closing the magnetic relay 3 and series-connecting the first and second magnetic vias 18*a*, 18*b*.

The interruption of the current I supplied by the current source 32 determines the end of energization of the coils 15*a*, 15*b* and removes the magnetic field generated thereby. Consequently, the attraction force between the beam 25 and the second coil 18*b* ceases, and the beam 25 goes back into the rest position, thus opening the relay 3.

In practice, when the magnetic relay 3 is closed, the magnetic vias 18*a*, 18*b* operate simultaneously as electric vias and are able to carry DC or AC electrical signals, possibly modulated and superimposed on one another.

Consequently, the magnetic relay 3 has a structure that is very compact and reliable. In fact, the magnetic vias 18*a*, 18*b* concentrate and guide the magnetic field lines along the beam 25, ensuring a high attraction force even with a low magnetic field B (low current I). In addition, the arrangement also enables switching of high currents; in this case, in fact, it is possible to select the desired thickness of the second substrate 17, calculated so as to withstand the high related electrical fields, without any risks of breakdown. Moreover, by appropriately choosing the electrical parameters of the second substrate 17 (in particular high resistivity), it is possible to switch high currents with low losses.

Provision of the relays 3 in the second body 2 moreover enables separation of the electronic components (integrated in the first body 1) from the magnetic ones (provided in the second body 2). In this way, manufacturing is simplified (for example, the ASIC may be manufactured using standard techniques and solutions), the costs of the device are reduced, as well as the risks of contamination, and the reliability over time increases.

Obviously, the geometry of the magnetic relay 3 may be modified so that it is normally closed and is opened when it is activated through the current source 32. This dual solution, in fact, may be easily obtained by having the contact portion 25*c* of the beam 25 normally bent downwards or coplanar with the anchorage portion so as to be, at rest, in contact with the core 19 of the second magnetic via 18*b*. In this case, the second coil 15*b* may be connected in an opposite way so that (in the example illustrated) its outer terminal is connected to the inner terminal of the first coil 15*a* and its inner terminal is connected to the current source 32. In this way, the second coil 15*b* is passed by a current in the same direction as the first coil 15*a*, and generates concordant magnetic fields in the coils 18*a*, 18*b*. Thereby, the contact portion 25*c* of the beam 25 and the second magnetic via 18*b* form magnetic poles having the same sign and thus repel one another as long as the coils 15*a*, 15*b* are supplied.

Figure 4:
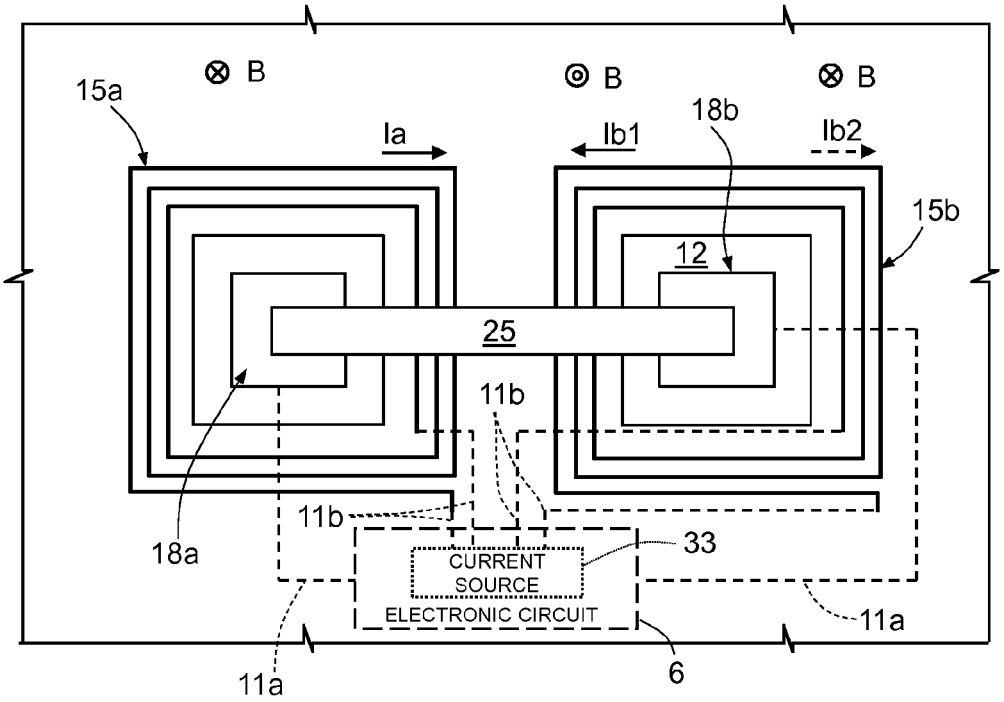
FIG. 4 shows a variant of the connection of FIG. 3.

FIG. 4 shows an arrangement that enables generating both an attraction and a repulsion force between the contact portion 25*c* of the beam 25 and the second magnetic via 18*b*.

To this end, here the two coils 15*a*, 15*b* are not serially connected, but each coil 15*a*, 15*b* is individually connected to a current source 33, here shown integrated in the electronic circuit 6. Due to the independent connection of the coils 15*a*, 15*b*, the current source 33 supplies the first coil 15*a* with a first current Ia and the second coil 15*b* with a second current Ib1 or Ib2 flowing, respectively, in an opposite direction and in a same direction as the first current Ia. The currents Ia, Ib1, Ib2 may have the same value I or a different value.

As an alternative to what is shown, the current source may be provided with just one pair of current-supply terminals, and a switching circuit may, for example, reverse the direction of the current to the second coil 15*b*, when desired, as explained hereinafter.

In particular, when the current source 33 generates the current Ib1, supplied to the second coil 15*b* so as to flow in an opposite direction (counterclockwise direction in FIG. 4) with respect to the current Ia in the first coil 15*a* (which flows in a clockwise direction), the relay 3 operates in the way described above with reference to FIG. 3, due to the attraction forces between the contact portion 25*c* of the beam 25 and the second magnetic via 18*b*, closing the relay.

Instead, when the current source 33 generates the current Ib2, which flows in the second coil 15*b* in the same direction as the current Ia (clockwise direction in FIG. 4), the contact portion 25*c* of the beam 25 and the second magnetic via 18*b* form concordant magnetic poles, which repel one another.

Figure 5:
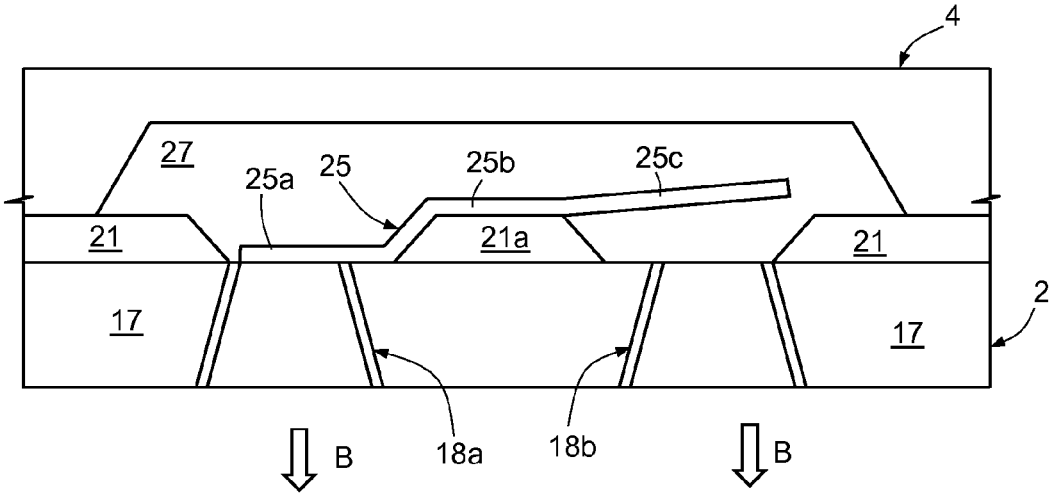
FIG. 5 shows the behavior of the device of FIG. 1 with the connection of FIG. 4.

In use, the current source 33 initially generates the currents Ia, Ib1, closing the magnetic relay 3 and thus routing a switched current according to a desired conductive path, as explained above, and then the currents Ia, Ib2 so as to open the relay 3 and interrupt the electrical signal (FIG. 5).

In this way, when the circuit is to be opened, switching of the relay 3 is controlled actively, and takes place in an immediate and safe way. In fact, the generation of a repulsive force enables the adhesion force between the contact portion 25*c* and the second magnetic via 18*b* to be rapidly overcome, facilitating their detachment, reducing and in some cases preventing onset of harmful sparks that could, with time, damage the structure and reduce the duration of the magnetic relay 3, for example caused by an erosion of the electrical contacts.

The duration of the active open phase (repulsion phase) of the magnetic relay 3 may be short so as to prevent significant consumptions.

In addition, the active opening control has the advantage of safely bringing back the beam 25, and in particular its contact portion 25*c*, into its original rest position, preventing any problems due to elasticity loss and permanent deformation of the beam 25 (for example, warping of the contact portion 25*c* towards the second magnetic via 18*b* after prolonged use), which could also reduce the service life and the reliability of the magnetic relay 3.

Obviously, also in this case, the structure may be modified in so that the magnetic relay 3 is normally closed and is opened upon command by the current source 33. Also in this case, the possibility of controlling the movement of the contact portion 25*c* so that it approaches and moves away from the second magnetic via 18*b* facilitates the switching and prolongs the service life of the magnetic relay 3.

Figure 6:
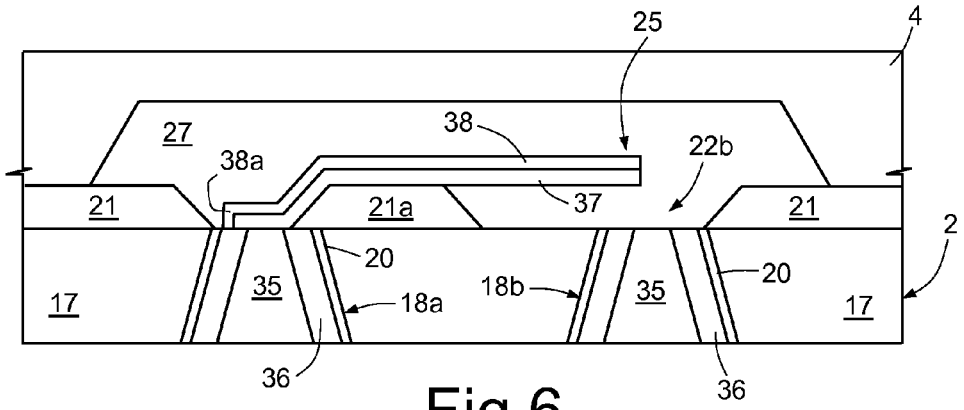
FIG. 6 shows a cross-section of a different embodiment of the present device.

FIG. 6 shows a different embodiment of the magnetic relay 3. In detail, here the magnetic vias 18*a*, 18*b* are of a hybrid type and each have an intermediate portion 35 of a good electrical conductor and non-magnetic or diamagnetic material (such as, e.g., aluminum, copper, tungsten, gold, platinum, silver, cobalt, palladium, nickel, rhodium, manganese, iron, molybdenum, rhenium, iron, zinc, iridium and their alloys together also with other materials, for example having resistivity p lower than 0.1 Ωm and preferably lower than $10^{-3}$ Ωm) and a peripheral portion 36 of ferromagnetic material (for example permalloy, CoZrTa, CoZrO, FeHfN(O) and the like).

The beam 25 is also formed by non-homogeneous materials: here the bottom part 37 of the beam 25 is of an electrically good conductive material, for example the same material as the intermediate portion of the magnetic vias 18*a*, 18*b* (or in any case of the same class), and the top part 38 is of ferromagnetic material, for example one of the materials indicated above for the peripheral portion 36.

In detail, the bottom part 37 of the beam 25 is in electrical contact with the intermediate portion 35 of the magnetic via 18*a*, and the beam is configured so that, in the closing phase, the bottom part 37 is in electrical contact with the intermediate portion 35 of the magnetic via 18*a*. Alternatively, conductive regions (not shown) may be arranged between the bottom part 37 of the beam 25 and the central portions 35 of the magnetic vias 18*a*, 18*b*.

Moreover, preferably, the top part 38 of the beam 25 extends laterally to the bottom part 37 at the magnetic via 18*a* so as to be directly in contact with the peripheral portion 36 thereof.

Thereby, the magnetic vias 18*a*, 18*b* and the beam 25 are able to carry higher currents, all the other parameters being equal.

In a variant the beam 25 may be of ferromagnetic material coated by at least one electrically good conductive material layer.

Figure 7:
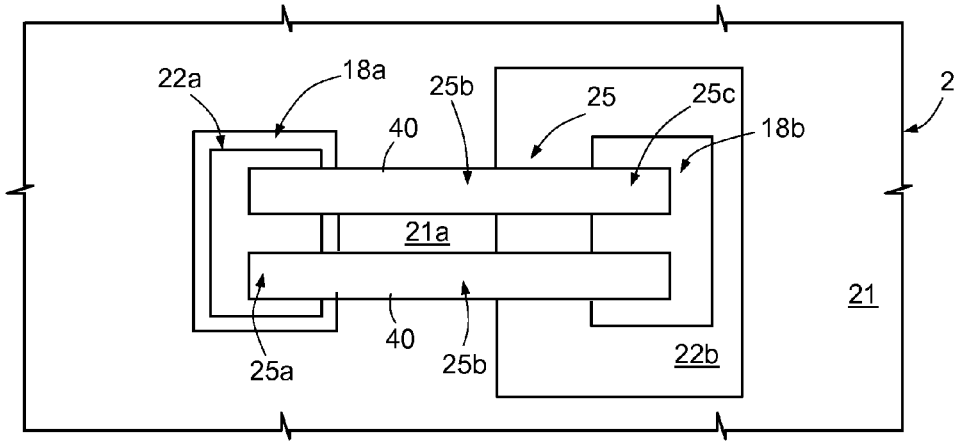
FIGS. 7 and 8 show top plan views of variants of the device of FIG. 1.

The shape of the beam 25 and its connection to the magnetic vias 18*a*, 18*b* may differ from the one shown in FIG. 1. For example, FIG. 7 shows a solution in which the beam 25 is formed by two beam elements 40 in parallel. Here, the beam elements 40 are equal and are fixed to an anchorage portion (designated once again by 25*a*, for uniformity) to the first magnetic via 18*a*, have an intermediate portion 25*b*, extending over the insulating portion 21*a* of the second insulating layer 21, and a contact portion 25*c*, extending over the second magnetic via.

The shape and number of beam elements 40 may also differ.

This solution enables an increase in the current capacity of the beam 25, without reducing the flexibility thereof, since the dimensions of the individual beam elements 40 may be optimized on the basis of the mechanical characteristics thereof, irrespective of the cross-section intended for current conduction.

Figure 8:
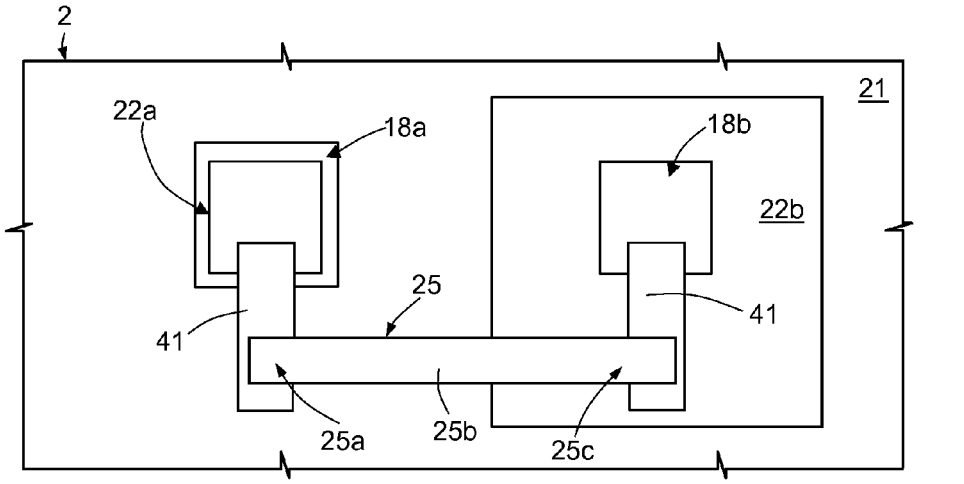

In FIG. 8, the beam 25 extends laterally the magnetic vias 18*a*, 18*b*, and the contact is obtained through magnetic strips 41, each having a portion in contact with the respective magnetic via 18*a*, 18*b* and a portion arranged above the second insulating layer 21, for electrical connection with the respective beam portion 25*a*, 25*c*.

This solution is advantageous when the area of the top base of the magnetic vias 18*a*, 18*b* does not enable direct contact with more beam elements 40.

Obviously, the solutions of FIGS. 7 and 8 may be combined.

Figure 9:
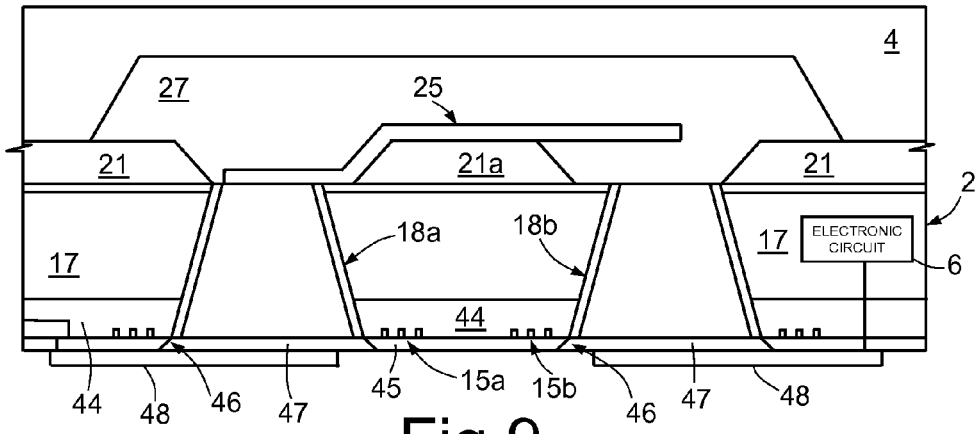
FIGS. 9 and 10 show cross-sections of different embodiments of the present device.

FIG. 9 shows an embodiment where the coils 15*a*, 15*b* are formed in the second body 2. The first body 1 may be absent. In this case, a bottom insulating layer 44 extends on the first surface 17*a* of the second substrate 17, is traversed by the magnetic vias 18*a*, 18*b* and embeds the coils 15*a*, 15*b*. A passivation layer 45 extends underneath the bottom insulating layer 44 and has openings 46 at the magnetic vias 18*a*, 18*b*. The openings 46 may house contact pads 47 in contact with conductive lines 48, for electrically connecting the magnetic vias 18*a*, 18*b* with the electric circuit 6, here integrated in the second substrate 17. The contact pads 47 may even be absent, as the conductive lines 48.

As an alternative, the first body 1 may be present, analogously to FIG. 1, and house the conductive lines 48.

Figure 10:
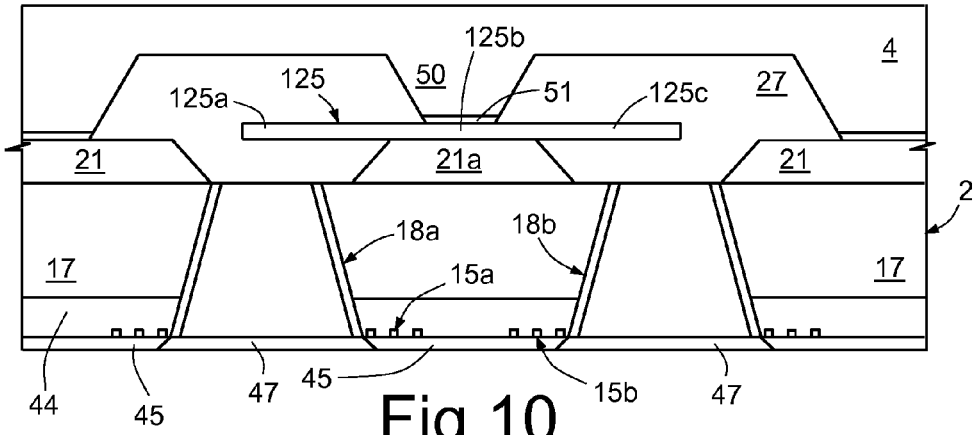

FIG. 10 shows an embodiment where a beam 125 forms a double electrical contact. In detail, the beam 125, of ferromagnetic material as the beam 25 of FIG. 1, is here once again formed by three parts, a first end portion 125*a*, an intermediate portion 125*b*, and a second end portion 125*c*, but here the intermediate portion 125*b* forms the anchorage portion, and the first end portion 125*a* extends in cantilever fashion, like the second end portion 125*c*, so as to open and close the electrical contact with the first magnetic via 18*a*. Here, the cap 4 has a projection 50 vertically aligned with the insulating portion 21*a* of the second insulation layer 21 and extending throughout the depth of the cavity 27 so as to block the intermediate portion 125*b* of the beam 25. An insulating layer 51, for example of oxide, may extend between the projection 50 and the beam 125, for electrical insulation.

In the embodiment shown, the coils 15*a*, 15*b* are formed in the bottom insulating layer 44 as in FIG. 9. As an alternative, if the first body 1 is present, they may be provided in the first insulating layer of the first body 1 (not shown).

The presence of a double contact formed by a same beam 125 increases (in some embodiments, doubles) the insulation voltage that the device may withstand in open-circuit conditions. Also this embodiment has the same controlled closing and opening characteristics already described in regard to the previous embodiments.

Figure 11:
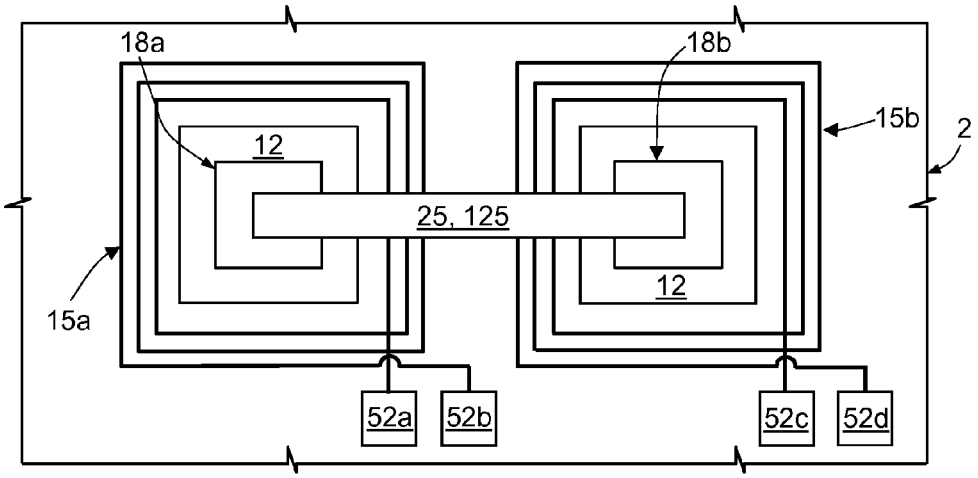
FIG. 11 shows a variant of the connection of FIG. 3 that may be used with the device of FIG. 10.

The coils 15*a*, 15*b* of FIG. 10 may be supplied through their own contact pads, as shown in FIG. 11. Here, the ends of the coils 15*a*, 15*b* are connected to respective coil contact pads 52*a*-52*d*, which in turn are connected to two different supply circuits. Alternatively, in a not shown manner, the pads 52*a*-52*b* may be connected together so as to serially connect the coils 15*a*, 15*b*, as shown in FIG. 3.

Figure 12:
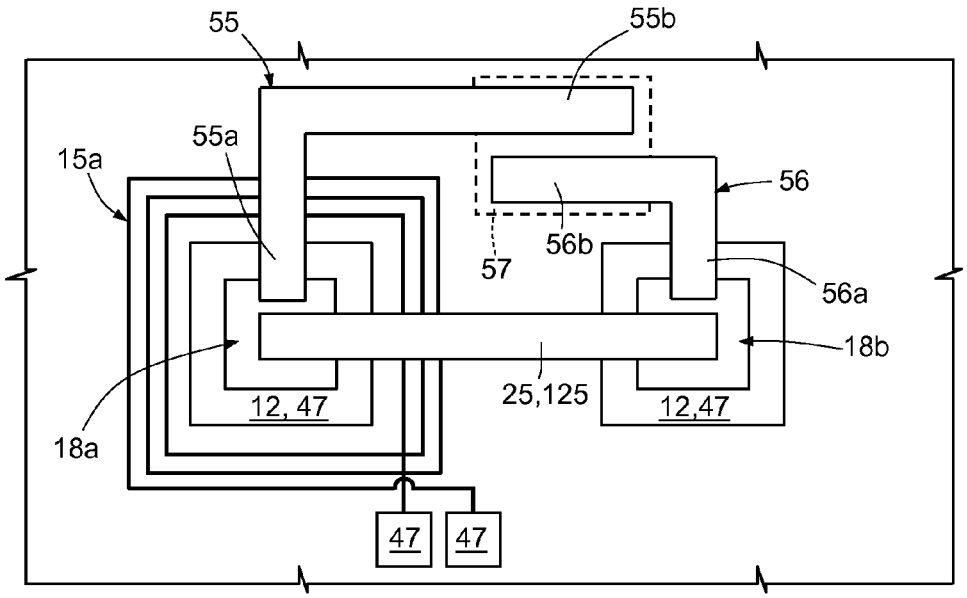
FIG. 12 shows a different embodiment of the connection.

It is possible to reduce the reluctance of the magnetic circuit comprising the magnetic vias 18*a*, 18*b* using magnetic strips that connect to the respective cores 19 and thus close the magnetic circuit. The magnetic strips may be arranged, for example, in the bottom insulating layer 44 of FIG. 9 or in the first insulating layer 10 of FIG. 1. For example, using magnetic strips that are not electrically conductive (for example, of ferrite), it is possible to form a single strip that connects the cores 19 of the magnetic vias 18*a*, 18*b*. Otherwise, if the ferromagnetic material of the strips is electrically conductive, e.g., of the same material as the beam 25, 125, there an interruption along the magnetic strips may be provided. For example, FIG. 12 shows a magnetic circuit for connecting the magnetic vias 18*a*, 18*b* formed by two magnetic strips 55 and 56, each having a first end 55*a*, 56*a* and a second end 55*b*, 56*b*. The first ends 55*a*, 56*a* are in direct contact with the respective cores 19, and the second ends 55*b*, 56*b* extend parallel to one another so as to form a fringing capacitor 57.

In this case, it is also possible to have a single coil 15*a*, 15*b*, arranged for example in proximity of the first magnetic via 18*a*, as shown in FIG. 12.

Due to the fringing capacitor 57, it is possible to reduce the wear of the electrical contacts (contact end 25*c* or end portions 125*a*, 125*c* and portion of the facing core/cores 19) due to sparking (for example, in case of inductive loads).

Figure 13:
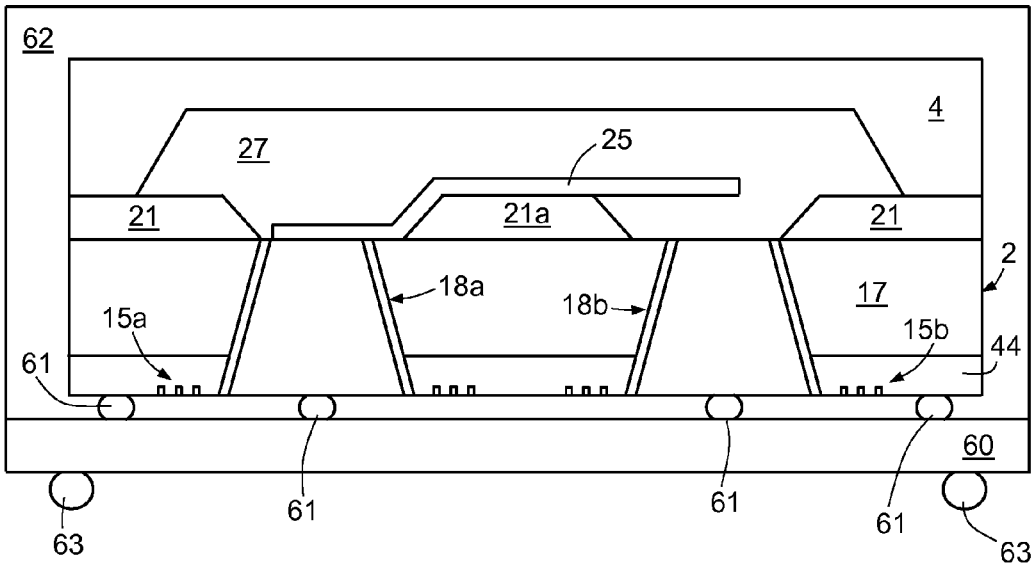
FIG. 13 shows a different embodiment of the present device.

FIG. 13 shows a packaged relay integrated device. Here, the second body 2, having a bottom insulating layer 44 similar to FIG. 9, is fixed to a support 60 via first conductive balls 61 according to the BGA (ball-grid array) technique.

The support 60 has greater dimensions than the ensemble formed by the second body 2 and the cap 4, and a package 62 coats them completely and fixes them to the support 60. For example, the package 62 is of resin, and the support 60 may be a printed-circuit board (or PCB). In turn, the support 60 may be provided with second balls 63 for connection, for example, to a further printed circuit (not shown).

Figure 14:
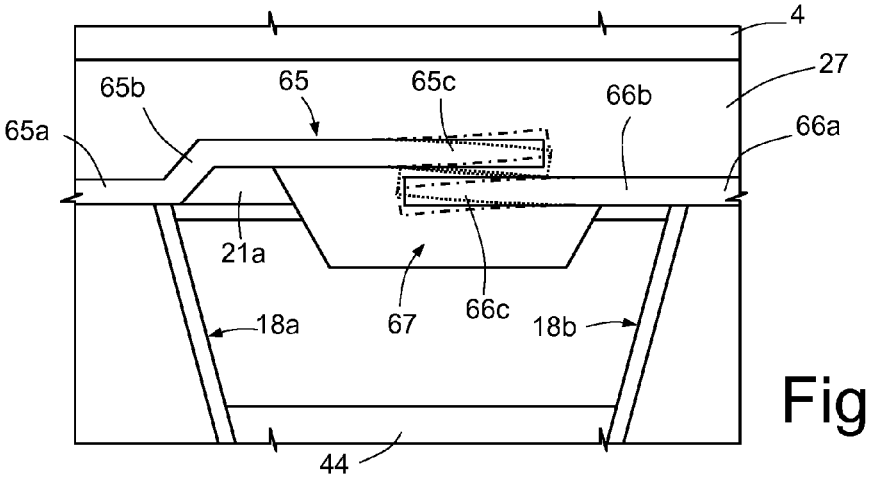
FIG. 14 shows a different embodiment of the present device.

FIG. 14 shows an embodiment where the contact structure comprises a first and a second beam 65, 66, which are fixed, respectively, to the first and second magnetic vias 18*a*, 18*b* through an anchorage portion 65*a*, 66*a* and which have respective contact portions 65*c*, 66*c* movable towards or away from one another. In the example illustrated, the first beam 65 is obtained in a way similar to the beam 25 of FIG. 1, except that it has a smaller length, and comprises an intermediate portion 65*b* which extends above the insulating portion 21*a* of the second insulating layer 21. The second beam 66 extends at a lower level than the first beam 65, and its contact portion 65*c* extends above a cavity 67 facing the second surface 17*b* of the second substrate 17. The second beam 66 here has a planar structure and an intermediate portion 66*b* is aligned to the anchorage portion 66*a* and to the contact portion 66*c*.

The contact structure of FIG. 14 may operate as described with reference to FIGS. 4 and 5. In detail, in the rest position (shown with a solid line in FIG. 14), because of the different level of the beams 65, 66, the latter are electrically disconnected. By causing passage of opposite currents in the coils 15*a*, 15*b*, an attraction force is generated between the beams 65, 66, causing their contact portions 65*c*, 66*c* to bend towards each other and reaching the position shown with dashed line. Upon opening of the relay 3, one of the coils 15*a*, 15*b* is supplied with a current having an opposite direction with respect to the contact-closing phase so that, between the contact portions 65*c*, 66*c*, a repulsive force is generated that causes a fast detachment thereof and their movement to the repulsion position shown with dash-and-dot line. Removal of supply to the coils 15*a*, 15*b* brings the beams 65, 66 back into the rest position.

As an alternative to what has been shown, the second beam 66 may not be planar. For example, the second beam 66 could have an intermediate portion 66*b* having an upwardly inclined stretch, as for the intermediate portion 65*b* of the first beam 65, and a downwardly inclined stretch so that the contact portion 66*c* extends at a lower level than the contact portion 65*c* of the first beam. Obviously, many other embodiments may be devised, such as for example providing the contact portion 66*c* of the second beam 66 at a higher level than the contact portion 65*c* of the first beam.

In the previous embodiments, the beam or beams of the contact structure are mobile transversely to the plane defined by the second surface 17*b* of the second substrate 17; namely, they may rotate about axes coplanar to the second surface 17*b*.

Figure 15:
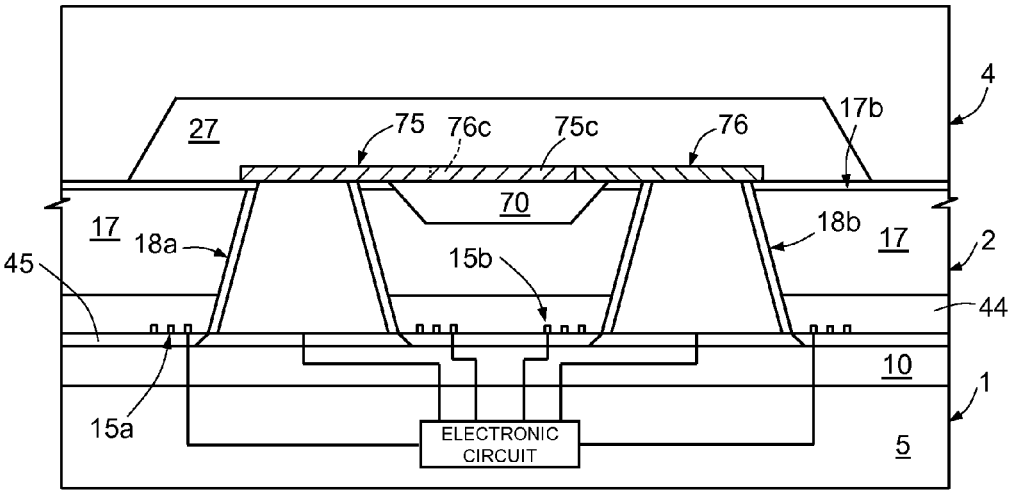
FIGS. 15 and 16 show, respectively, a cross-section and a top plan view of a different embodiment of the present device.
Figure 16:
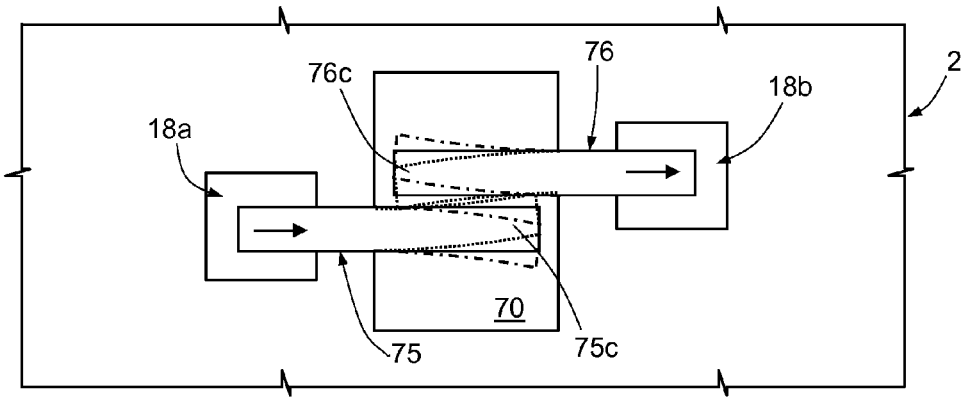

FIGS. 15 and 16 show, instead, an embodiment where the contact structure is flexible in a horizontal direction, parallel to the second surface 17*b*; i.e., its elements can turn about axes perpendicular or in any case transverse to the second surface 17*b*. In detail, here the contact structure comprises two beams 75, 76, the contact portions whereof are arranged at the same level and are laterally flexible.

Here, the beams 75, 76 are completely planar and both respective contact portions 75*c*, 76*c* extend over a cavity 70 facing the second surface 17*b* of the second substrate 17. Here, the second insulating layer 21 is no longer present, and a thin layer 71, e.g., of oxide, electrically insulate the beams 75, 76 and the second substrate 17.

Also in this case, in absence of a magnetic field (coils 15*a*, 15*b* not supplied), the beams 75, 76 are at a distance from each other, in the rest position (shown with solid line in FIG. 16), and the circuit is open. By supplying appropriate currents to the coils 15*a*, 15*b*, as explained above, so as to have opposite poles on the contact portions 75*c*, 76*c*, the beams 75, 76 attract and bend to close the circuit, moving to a contact position (shown with dashed line). By applying a magnetic field so as to have two equal poles on the contact portions 75*c*, 76*c*, the beams 75, 76 repel one another and deflect to open the contact (repulsion condition shown with dash-and-dot line).

As an alternative to what shown in FIGS. 15 and 16, just one beam may be provided, for example the beam 75, having a length such as to end laterally to an expansion of the second magnetic via 18*b*. In this case, the cavity 70 could have larger dimensions and extend to surround, on at least one side, the second magnetic via 18*b* to enable a free horizontal movement (parallel to the second surface 17*b* of the second substrate 17) of the single beam 75 so as to open/close the magnetic relay. As an alternative, the beams 75 and 76 may have raised contact portions, like the beam 25.

The device described herein has numerous advantages. First, the magnetic vias in contact with the contact structure (beam 25, 65 or 75, 76, 125) make it possible to confine and "carry" the magnetic field as far as the contact structure and simultaneously carry the electrical signal to be switched. Consequently, the device is particularly compact and very reliable. In fact, even though the coils 15*a*, 15*b* are arranged at a distance from the beam/beams (in particular, in the case of high-power signals that desire a great thickness of the beam/beams), concentration of the magnetic field in the magnetic vias enables the forces generated on the beam to be such as to ensure closing and/or opening of the magnetic relay.

Due to the possibility of generating in different moments both attraction and repulsion forces, opening the contact may be speeded up, at the same time reducing the sparks generally associated to switching. This improves the reliability and duration of the device, also due to the active control to bring back the beam/beams into the rest position and thus prevent any permanent deformation.

Functionality of the device may be tested by simply using magnetic probes brought into contact with the magnetic vias or with appropriate expansions thereof, before coupling the second body 2 to the first body 1. In this case, also the magnetic probes may be conductive so as to enable circulation of an electrical signal and are also magnetically coupled to coils, which, appropriately supplied, enable closing or opening of the electrical contact.

As compared to solid-state switches (for example, power MOSs and BJTs, IGBTs, TRIACs), there is less heating, due to the reduction of the resistance of the conductive path passed by the current. The described relay thus does not require the use of cumbersome heat dissipators, thus reducing the dimensions of the system as a whole as well as its cost.

Finally, it is clear that modifications and variations may be made to the device described and illustrated herein, without thereby departing from the scope of the present disclosure.

For example, the core 19 of the magnetic vias 18*a*, 18*b* may project also beyond the second surface 17*b* of the second substrate 17, and the projecting part be surrounded by the second insulating layer 21 so as to guarantee insulation between the magnetic vias 18*a*, 18*b* and the second substrate 17. Alternatively, the coating 20 of the magnetic vias 18*a*, 18*b* may have a parallel portion facing the second surface 17*b* of the second substrate 17.

The core 19 of the magnetic via 18*a*, 18*b*, may also be obtained with thin-film deposition techniques and have a cavity.

In general, the magnetic materials used here for the cores 19, the beam 25, and possible magnetic expansions 41; 55, 56 may be include materials such as Co, Fe, Ni and their alloys together also with other materials.

When the first body 1 is provided, the windings of the coils 15*a*, 15*b* may be arranged, instead of inside the first insulating layer 10, above it, via post-processing steps. In this case, they project from the surface of the first body 1. Thus, to enable electrical contact between the contact pads 12 and the magnetic vias 18, the latter may from the first surface 17*a* of the second substrate 17 or conductive material may be arranged between the magnetic vias 18 and the contact pads 12.

According to whether the geometrical dimensions of the beam/beams are micrometric or nanometric it is possible to provide devices of a MEMS or NEMS type, respectively.

Advantageously, a plurality of relays may be provided in a same device. Moreover at least two of them may possibly have in common at least one magnetic via.

Via the ASIC, it is possible to provide for example twilight relays, timed relays, programmable relays, protection relays.

In a variant not shown, one of the coils 15*a* or 15*b*, for example the coil 15*a*, may be missing, and, in order to magnetize the beam 25, 65, 66, 75, 76, a permanent magnet may be provided, for example of a hard magnetic material, such as AlNiCo, $SmCo_5$, NdFeB, $SrFe_{12}O_{19}$, $Sm(Co,Fe,Cu,Zr)_7$, FeCrCo, PtCo or equivalent materials. This material may replace part of the soft magnetic material of the magnetic circuit, for example, with reference to FIG. 6, the material of the peripheral portion 36 of the magnetic via (18*a*), or the material of the top part 38 of the beam 25. In this way, the beam 25 may have a magnetic polarity (for example, a south pole) in its contact portion 25*c*, which is attracted or repelled by the magnetic field generated, for example, by the coil 15*b*. In this way, it is possible to attract or repel the contact portion 25*c* of the beam 25 using a single coil.

Many hybrid implementations are obviously possible in addition to the ones shown, as well as also with the technique, without thereby departing from the scope of the present disclosure.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A magnetic relay device comprising:

a substrate of semiconductor material having a first surface and a second surface;

a first magnetic via that includes ferromagnetic and electrically conductive material extending through the substrate between the first and second surfaces;

a second magnetic via that includes ferromagnetic and electrically conductive material extending through the substrate between the first and second surfaces;

a magnetic-field generator arranged underneath the first surface in proximity to at least one of the first and second magnetic vias; and a contact structure that includes ferromagnetic material arranged above the second surface and controlled by the magnetic-field generator so as to switch between an open position in which the contact structure electrically disconnects the first and second magnetic vias, and a closed position in which the contact structure electrically connects the first and second magnetic vias.

2. The device according to claim 1, wherein the first magnetic via has a central axis along a first axis and the magnetic-field generator comprises a first coil that surrounds the first axis.

3. The device according to claim 2, wherein the magnetic-field generator comprises a second coil, the first coil being arranged in proximity to the first magnetic via, and the second coil being arranged in proximity to the second magnetic via.

4. The device according to claim 3, wherein the first and second coils are arranged in series and connected to a current source.

5. The device according to claim 3, comprising a current source coupled to the first and second coils, the first and second coils and the current source being configured to generate first and second magnetic fields in the first and second magnetic vias, respectively, the first and second magnetic fields generating an attraction force between the contact structure and at least one of the first and second magnetic vias in the close position of the contact structure and generating a repulsion force between the contact structure and the at least one magnetic via in the opening position.

6. The device according to claim 2, wherein at least one of the first and second magnetic vias comprises a permanent magnet, and the first coil is arranged adjacent to the other of the first and second magnetic vias.

7. The device according to claim 6, wherein the permanent magnet is formed from a hard magnetic material and includes at least one AlNiCo, $SmCo_5$, NdFeB, $SrFe_{12}O_{19}$, $Sm(Co,Fe,Cu,Zr)_7$, FeCrCo, and PtCo.

8. The device according to claim 1, wherein:

the contact structure comprises a beam element having an anchorage portion and a cantilever portion, the anchorage portion being fixed to and in electrical contact with the first magnetic via; and the cantilever portion being electrically disconnected from the second magnetic via when the contact structure is in the open position and being bent in electrical contact with the second magnetic via when the contact structure is in the close position.

9. The device according to claim 8, wherein the cantilever portion of the beam element is flexible transversely to the second surface of the substrate, the cantilever portion of the beam element being movable between a first position arranged at a first non-zero distance from the second surface when the contact structure is in an open position and a second position in electrical contact with the second magnetic via when the contact structure is in the close position.

10. The device according to claim 9, wherein:

the anchorage portion extends at a second distance from the second surface smaller than the first distance and is connected to the contact structure through an intermediate portion; and an insulating region extending on the second surface of the substrate underneath the intermediate portion.

11. The device according to claim 8, wherein the cantilever portion has a bent end facing the second magnetic via.

12. The device according to claim 8, wherein the anchorage portion and the cantilever portion of the beam element extend at a same distance from the second surface, the cantilever portion being flexible parallel to the second surface of the second substrate.

13. The device according to claim 12, wherein the contact structure comprises a closing beam having an anchorage portion in electrical contact with the second magnetic via, the cantilever portions of the beam element and of the closing beam being movable between a mutually distanced position when the contact structure is in the open position and a mutual electrical-contact position when the contact structure is in the close position.

14. The device according to claim 12, wherein the substrate has a cavity arranged underneath the cantilever portion of the beam element and of the closing beam.

15. The device according to claim 8, wherein the beam element comprises an intermediate anchorage portion, a first cantilever portion and a second cantilever portion, the anchorage portion being fixed to the substrate and the first and second cantilever portions extending above and at a distance from the first magnetic via and the second magnetic via, respectively, the first and second cantilever portions being flexible transversely to the second surface between a position at a non-zero distance from the second surface when the contact structure is in the open position and a position of electrical contact with the first and second magnetic vias, respectively, when the contact structure is in the close position.

16. The device according to claim 1, comprising a body housing an integrated electronic circuit, the body being fixed to the first surface of the substrate and including lines for electrical connection to the first and second magnetic vias.

17. The device according to claim 16, comprising an insulating layer arranged between the substrate and the body, the insulating layer housing electrical-connection structures and the magnetic-field generator.

18. The device according to claim 1, comprising at least one magnetic expansion extending over at least one of the first and second surfaces starting from at least one of the first and second magnetic vias, the magnetic expansion forming a fringing capacitor.

19. A method for controlling a relay device, the method comprising:

using a first coil arranged proximate to a first magnetic via in a semiconductor substrate, generating a first magnetic field in the first magnetic via so as to magnetize in an opposite way facing portions of a contact structure and of a second magnetic via in the semiconductor substrate, and thereby causing an attraction force that places the facing portion of the contact structure in contact with the facing portion of the second magnetic via;

using a second coil arranged proximate to the second magnetic via in the semiconductor substrate, generating a second magnetic field in the second magnetic via, the second magnetic field in the second magnetic via being oriented opposite to the first magnetic field in the first magnetic via;

maintaining the first magnetic field generated by the first coil; and reversing, using the second coil, the second magnetic field in the second magnetic via so that the second magnetic field in the second magnetic via has a concordant direction with the first magnetic field in the first magnetic via, causing a repulsive force between the contact structure and the first magnetic via.

20. The method according to claim 19, wherein using the first coil arranged proximate to the first magnetic via, generating the first magnetic field in the first magnetic via comprises supplying current to the first coil to generate the first magnetic field in the first magnetic via.

21. A magnetic relay device comprising:

a semiconductor substrate having a first surface and a second surface;

a first magnetic via extending through the substrate between the first and second surfaces;

a second magnetic via extending through the substrate between the first and second surfaces;

a first coil arranged proximity to the first magnetic via a second coil arranged proximate to the second magnetic vias; and a contact structure that includes ferromagnetic material arranged above the second surface, the contact structure having a first end that is coupled to a first surface of the first magnetic via, the contact structure having a second end suspended above a second surface of the second magnetic via, the second end being configured to move into contact with the second surface of the second magnetic via in response to magnetic fields of opposite signs being generated in the first and second magnetic vias.

22. The device according to claim 21, wherein the magnetic fields of opposite signs are generated in the first and second magnetic vias by supplying current to the first and second coils.

23. The device according to claim 21, wherein the first coil and the second coil are located proximate to the first surface of the semiconductor substrate, the first and second coils coiling outwardly in a plane about a respective central axis of the first and second magnetic vias.

* * * * *